US012758888B2

(12) United States Patent
Nie

(10) Patent No.: US 12,758,888 B2
(45) Date of Patent: Oct. 13, 2026

(54) SPIRAL HORN FOR A PLUSH TOY AND ITS MANUFACTURING PROCESS

(71) Applicant: PonyCycle, Inc., Puyallup, WA (US)

(72) Inventor: Xuejun Nie, Dalian (CN)

(73) Assignee: PonyCycle, Inc., Puyallup, WA (US)

( * ) Notice: Subject to any disclaimer, the term of this patent is extended or adjusted under 35 U.S.C. 154(b) by 179 days.

(21) Appl. No.: 18/795,436

(22) Filed: Aug. 6, 2024

(65) Prior Publication Data

US 2025/0249369 A1 Aug. 7, 2025

(30) Foreign Application Priority Data

Feb. 1, 2024 (CN) ..... 202410142999.7

(51) Int. Cl.
*A63H 3/02* (2006.01)
*A63H 9/00* (2006.01)

(52) U.S. Cl.
CPC ..... *A63H 3/02* (2013.01)

(58) Field of Classification Search
CPC ... A63H 3/02; A63H 9/00; A63H 3/48; A63H 3/36
See application file for complete search history.

(56) References Cited

U.S. PATENT DOCUMENTS 4,208,832 A * 6/1980 Corriveau ..... A63H 3/02 446/369
4,505,687 A * 3/1985 Munro ..... A63H 3/02 446/385
2007/0161324 A1* 7/2007 Garrett ..... A63H 3/46 446/369
2012/0289121 A1* 11/2012 Fiore ..... A63H 33/004 446/268

OTHER PUBLICATIONS

Thread the Needle Through—Free Shark Pattern; Jun. 2, 2011 https://threadtheneedlethrough.wordpress.com/2011/06/02/free-shark-pattern/ (Year: 2011).*

* cited by examiner

*Primary Examiner* — Kimberly S Berona
(74) *Attorney, Agent, or Firm* — Maier & Maier, PLLC

(57) ABSTRACT

A spiral horn for plush toys and its manufacturing process. The manufacturing process includes the following: cutting the fabric pieces and cut the fabric into two identical sickle-shaped horn pieces; sewing; overlap the two horn pieces; sew the curved edges on both sides to form the left seam, right seam, and bottom opening; sew the left seam and the right seam together to form the horn; sew the bottom opening of the horn onto the plush toy; and stuffing the spiral horn and the plush toy. The spiral horn can be made by three-dimensional cutting, and greatly improves the appearance after sewing.

4 Claims, 2 Drawing Sheets

SPIRAL HORN FOR A PLUSH TOY AND ITS MANUFACTURING PROCESS

TECHNICAL FIELD

The invention relates to a spiral horn for a plush toy and its manufacturing process, belonging to the technical field of toy manufacturing processes.

BACKGROUND

Existing plush toys with horns on the market typically feature horns made from a single piece of fabric, which undergoes flat cutting before further processing. After sewing, these horns have poor realism, the process involves sewing the two sides of the horn piece together, then attaching the horn to the plush toy.

After sewing the horn, the interior of the plush toy is stuffed, and the horn is sewn with a sewing machine. This requires rotating the entire plush toy during sewing, transforming a regular horn into a spiral horn. The resulting spiral horns often have a poor appearance, with inconsistent sizes, asymmetry, and wrinkles, failing to meet high-quality standards. Additionally, the process is cumbersome, requiring the operator to rotate the entire plush toy while sewing to achieve the spiral effect. This demands high technical skill from the operator, especially when making medium to large plush toys, making the process particularly challenging.

In summary, the current technology is time-consuming and labor-intensive, and the resulting horns do not meet high-quality standards, indicating an urgent need for improvement in the related processes.

SUMMARY

To solve the technical problems, the invention discloses a spiral horn manufacturing process for plush toys, comprising the following steps:

Step 1: Cutting

Cutting a first horn-shaped piece and a second horn-shaped piece, both having a crescent shape.

Step 2: Sewing 2.1: Overlap the first and second horn-shaped pieces so that the concave edge of the first piece aligns with the convex edge of the second piece.

2.2: Sew the curved edges on both sides to create left and right seams, leaving an opening at the bottom.

2.3: Sew together the left and right seams, then invert the piece inside out to form the horn.

2.4: Attach the bottom opening of the horn to the plush toy.

Step 3: Stuffing

Stuff the spiral horn and plush toy.

Further, the specific operation process of step 2.3 is as follows: take the vertical centerline of the horn as the folding line, fold the left seam to the position of the right seam, aligning the sewing lines of both seams. Sew a new seam 2±0.5 cm below the top and 3.5±1 cm above the bottom, 0-1.5 mm outside the existing seam, and secure both ends of the new seam with backstitches. Flip the piece from the reverse side to the front to form the horn.

Further, the cutting described in step 1 is three-dimensional cutting.

Further, the sewing described in step 2 is done using a sewing machine.

The invention also includes spiral horns for plush toys produced by any of the aforementioned production processes.

Beneficial Effects: The spiral horns of the invention, created through three-dimensional cutting, significantly improve the visual appearance after sewing. This innovation simplifies the existing complex production process, which is highly restrictive regarding the size of plush toys, into a straightforward and less challenging process that is suitable for manufacturing plush toys of all sizes.

Figure labels: 1—left seam joint, 2—right seam joint, 3—bottom opening, 4—first horn piece, 5—horn, 6—second horn piece, 7—new seam, 8—folding line.

DETAILED DESCRIPTION OF EMBODIMENTS

Based on the Figures and specific embodiments, the invention is further elucidated. These embodiments are provided for illustrative purposes and do not limit the scope of the invention. After reviewing this disclosure, those skilled in the art will recognize various equivalent modifications falling within the scope defined by the claims appended hereto.

Example of Implementation

Figure 1:
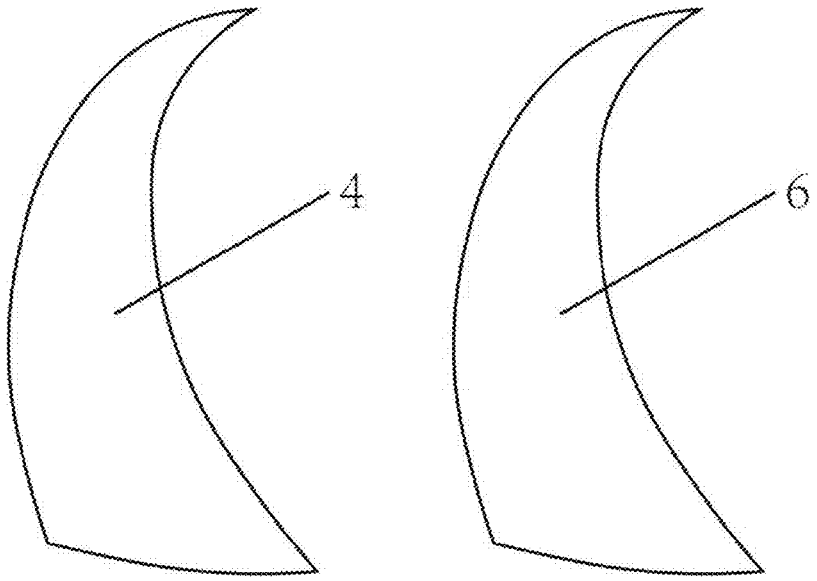
FIG. 1 is a schematic diagram showing a first horn piece and a second horn piece according to an exemplary embodiment of the invention.

As shown in FIG. 1, the spiral horn production process for plush toys according to the invention includes the following steps:

Step 1: Cutting

Perform three-dimensional cutting of the fabric to create two crescent-shaped horn pieces of identical shape, identified as the first horn piece 4 and the second horn piece 6, as shown in FIG. 1.

Step 2: Sewing 2.1: Overlap the first horn piece 4 and the second horn piece 6 so that the concave edge of the first horn piece 4 aligns with the convex edge of the second horn piece 6, with the right sides of the fabric facing each other.

Figure 2A:
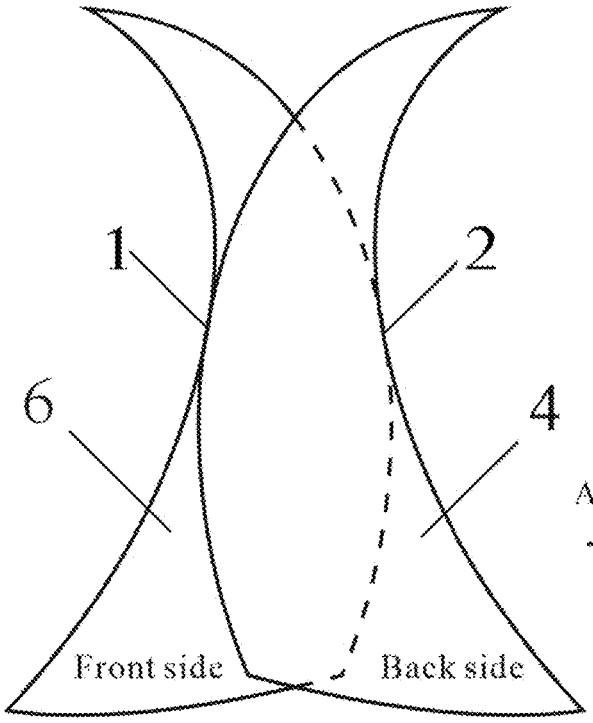
FIG. 2A is a schematic diagram showing the sewing of the curved edges of both sides of the horn pieces according to an exemplary embodiment of the invention, forming a left seam joint, a right seam joint, and a bottom opening.

2.2: Sew the curved edges on both sides using a sewing machine to create the left seam joint 1, right seam joint 2, and bottom opening 3, as illustrated in FIG. 2A.

Figure 2B:
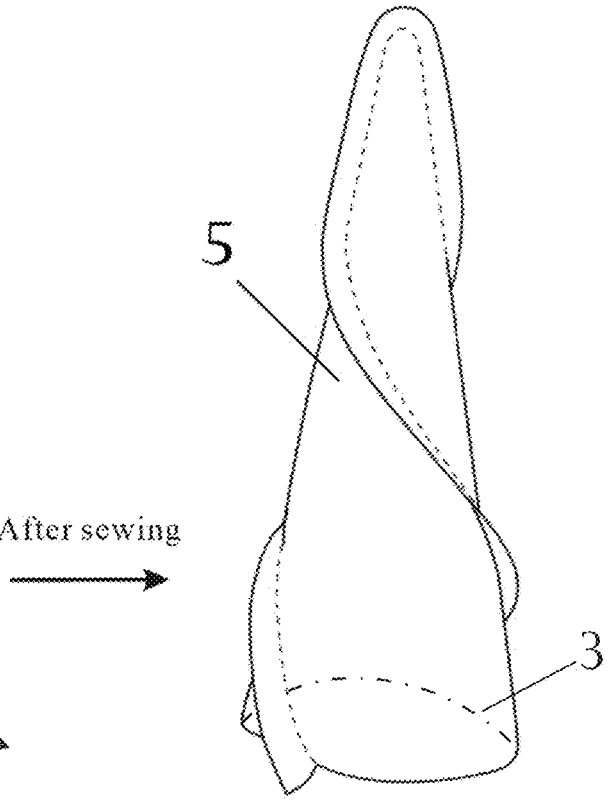
FIG. 2B is a schematic diagram showing the three dimensional shape of the horn after sewing according to an exemplary embodiment of the invention.
Figure 3:
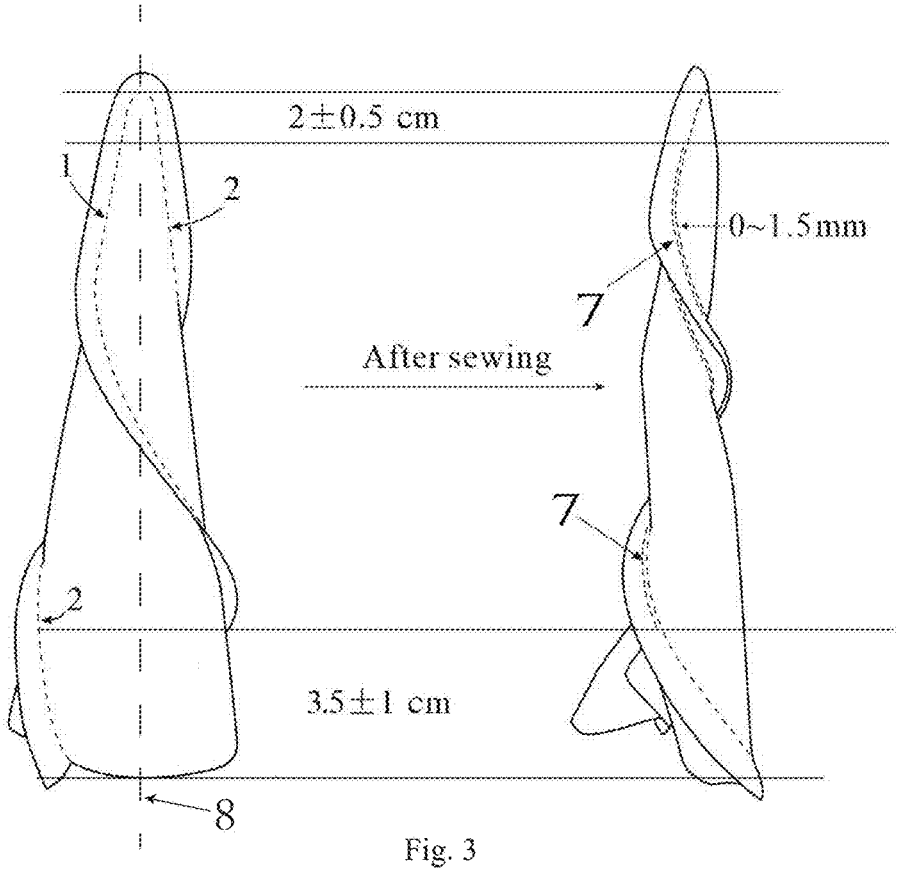
FIG. 3 is schematic diagram showing the three-dimensional shape of the horn and the sewing of a new seam according to an exemplary embodiment of the invention.
Figure 4:
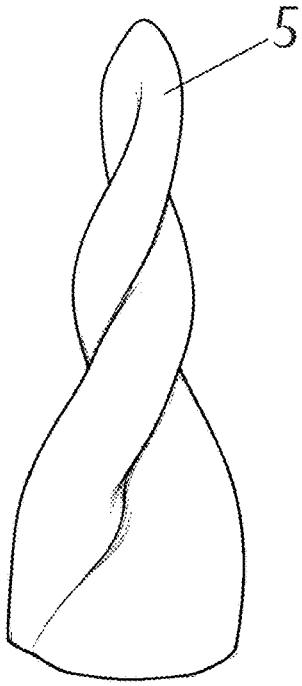
FIG. 4 shows the three-dimensional shape of the horn in a completed state according to an exemplary an embodiment of the invention.

2.3: Sew the left seam joint 1 and right seam joint 2 together using a sewing machine to form a horn 5 as shown in FIG. 2B. With reference to FIG. 4, the specific process is as follows: use the vertical centerline of horn 5 as the folding line 8, fold the left seam joint 1 to align with the position of the right seam joint 2, ensuring the sewing lines of both joints are aligned; sew a new sewing line 7 at 2±0.5 cm below the top and 3.5±1 cm above the bottom, 0-1.5 mm outside the sewing line, and secure the ends of this new sewing line 7 with backstitches. Flip the piece from the reverse side to the front to form horn 5 as shown in FIG. 4.

2.4: Use a sewing machine to sew the bottom opening 3 of horn 5 onto the plush toy.

Step 3: Stuff the Plush Toys with Horns.

Figure 5:
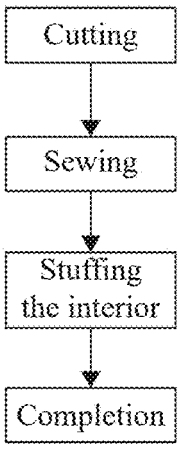
FIG. 5 is a flowchart of a manufacturing process for a spiral horn, according to an exemplary embodiment of the invention.

The spiral horn of the plush toy in the invention is produced using the manufacturing process. The three-dimensional shape of the horn is shown in FIG. 4. The production process of this invention is simple and easy, making it suitable for all plush toys. The process flow is illustrated in FIG. 5. By utilizing three-dimensional cutting and improved sewing techniques, the spiral horn significantly enhances the appearance. This innovation simplifies the existing complex production process, which is highly restrictive regarding the size of plush toys, into a straightforward and less challenging process that is suitable for manufacturing plush toys of all sizes.

For those skilled in the art, it is evident that the invention is not limited to the details of the exemplary embodiments provided above. Without departing from the spirit or essential characteristics of the invention, it can be implemented in other specific forms. Therefore, the embodiments should be considered as illustrative and non-limiting. The scope of the invention is defined by the appended claims, rather than the above description. Thus, all variations falling within the meaning and scope of the equivalent elements of the claims are intended to be encompassed within the scope of the invention. No drawing reference in the claims should be construed as limiting the scope of the claims involved.

Additionally, it should be understood that although this specification is described in terms of embodiments, not every embodiment necessarily includes a single independent technical solution. This descriptive approach is solely for clarity. Those skilled in the art should consider the specification as a whole, where the technical solutions in various embodiments can be appropriately combined to form other embodiments understandable to those skilled in the art.

The invention claimed is:

1. A manufacturing process for a spiral horn of a plush toy, comprising:

cutting a first horn piece and a second horn piece, wherein the first horn piece and the second horn piece are both identical in shape, and both the first horn piece and the second horn piece are sickle-shaped with three edges, including a convex curved edge, a concave curved edge, and a bottom edge;

sewing the first horn piece and the second horn piece together along the concave curved edge of the first horn piece and the convex curved edge of the second horn piece to form a left seam of a horn;

sewing together the convex curved edge of the first horn piece and the concave curved edge of the second horn piece to form a right seam of the horn;

turning the horn inside out through an unsewn bottom opening;

sewing the horn onto a plush toy along the unsewn bottom opening; and stuffing the horn.

2. The manufacturing process for a spiral horn of a plush toy according to claim 1, further comprising after sewing together the convex curved edge of the first horn piece and the concave curved edge of the second horn piece to form a right seam of the horn:

using a vertical centerline of the horn as a folding line to fold the left seam to the right seam and align sewing lines of the left seam and the right seam; and sewing a new seam 2.5 cm to 4.5 cm from the unsewn bottom opening of the horn to 1.5 cm to 2.5 cm cm from a top point of the horn opposite the unsewn bottom opening of the horn, wherein the new seam is 0-1.5 mm from the left seam and the right seam; and securing both ends of the new seam with backstitches.

3. The manufacturing process for a spiral horn of a plush toy according to claim 1, wherein the sewing is performed by a sewing machine.

4. A spiral horn for a plush toy, wherein the spiral horn is made by the manufacturing process of claim 1.

* * * * *